United States Patent [19]

Harrison

[11] Patent Number: 4,679,627

[45] Date of Patent: Jul. 14, 1987

[54] METHOD OF OIL RECOVERY

[76] Inventor: William M. Harrison, 6666 Chimney Rock, #14, Houston, Tex. 77081

[21] Appl. No.: 813,472

[22] Filed: Dec. 26, 1985

Related U.S. Application Data

[63] Continuation-in-part of Ser. No. 764,718, Aug. 12, 1985, Pat. No. 4,648,449.

[51] Int. Cl.[4] ..... E21B 43/25

[52] U.S. Cl. ..... 166/249; 166/177; 166/305.1

[58] Field of Search ..... 166/249, 177, 305.1

[56] References Cited

U.S. PATENT DOCUMENTS

| | | | |
|---|---|---|---|
| 3,279,538 | 10/1966 | Doscher | 166/305.1 |
| 3,401,748 | 9/1968 | Stratton | 166/305.1 |
| 3,405,762 | 10/1968 | Terwilliger | 166/305.1 |
| 3,422,894 | 1/1969 | Brandon | 166/249 |
| 3,525,400 | 8/1970 | Pollock et al. | 166/305.1 |
| 3,754,598 | 8/1973 | Holloway, Jr. | 166/249 |
| 3,794,114 | 2/1974 | Brandon | 166/249 |
| 4,417,621 | 11/1983 | Medlin et al. | 166/249 |

*Primary Examiner*—Stephen J. Novosad
*Assistant Examiner*—Bruce M. Kisliuk
*Attorney, Agent, or Firm*—Bill B. Berryhill

[57] ABSTRACT

A method of recovering petroleum fluids from an underground reservoir comprising the steps of: injecting into the reservoir a substantially water insoluble gas; generating and directing pressure waves into the reservoir to release petroleum fluids retained therein, and producing the released petroleum fluids through a well communicating with the reservoir. In alternate embodiments of the invention production is ceased and additional steps are performed to release additional petroleum fluids from the reservoir. These steps may include: injection of hydrocarbon solvents, or an aqueous solution rich in the sodium ion, or a detergent solution with or without additional pressure wave generation.

19 Claims, 3 Drawing Figures

METHOD OF OIL RECOVERY

CROSS-REFERENCE TO RELATED APPLICATIONS

The present application is a continuation-in-part of patent application Ser. No. 764,718, filed Aug. 12, 1985 now U.S. Pat. No. 4,648,449

BACKGROUND OF THE INVENTION

1. Field of the Invention

The present invention pertains to a method of recovering petroleum fluids from an underground reservoir. More specifically, it pertains to a method of recovering petroleum fluids particularly suited for recovering petroleum fluids retained in the reservoir after the production zone is watered out.

2. Description of the Prior Art

After an oil field is abandoned, fifty-two percent of the original oil (on a national average) remains trapped in the reservoir. Before secondary and tertiary recovery methods were developed to recover additional petroleum fluids trapped in the oil-bearing formation after initial production, this percentage was even higher, e.g. seventy percent.

There are several secondary and tertiary recovery methods utilized today. One of these is called "water flooding". In water flooding, water is pumped into the formation and pushes some of the remaining oil sideways instead of upward. Although water flooding may double production from a reservoir, the water must be clean, treated with bacteriacides and slimacides to prevent plugging. In addition, scale inhibitors may be required. The cost of water flooding may exceed $1 per barrel of water injected and may require a volume of water equal to twenty times the volume of oil displaced thereby.

Another secondary or tertiary method of production involves the introduction of gas during primary production. The gas replaces the oil as it is produced, maintaining a fairly steady water/oil contact. The oil in the gaseous region trickles down to the production zone. This method is primarily used with light crudes and is considered to be a rather poor recovery method.

An outmoded and seldom used secondary recovery method is burning gas by a downhole heater at the well face and forcing the hot gases into heavy oil zones to thin the oil for better production.

In steam injection, steam is injected into the formation. As the steam condenses, it gives off heat which thins the oil resulting in greater production. This method is widely used for heavy crudes. It may be considered a modified hot water flood.

In another method, carbon dioxide is injected into a reservoir. The carbon dioxide is dissolved, increasing the volume of the oil by about thirteen percent and also thinning the oil. This method requires as much as 12,000 to 20,000 cubic feet of carbon dioxide per barrel of oil (5.6 cubic feet per barrel). Although ten to fifteen percent more oil is recovered, this method is used only moderately today.

In a method similar to carbon dioxide injection, exhaust combustion gases are injected into the reservoir. Exhaust gases contain carbon dioxide and about ninety percent nitrogen which has little use other than as a heat carrier. This method is seldom used today.

In another method, solvent, frequently heated, is injected into the reservoir. By this method, a mixture of solvent and oil is obtained which is less viscous than the oil. This method is used with crudes which are almost tars.

Another recovery method is fire flooding. In fire flooding, air is injected into the reservoir and the reservoir is burned. Approximately thirteen percent of the oil is burned to recover the rest. The weight of air pumped into the reservoir exceeds the weight of oil produced. Furthermore, the heat produced by fire flooding can melt the sand in the formation into glass. Acids formed by this method may also destroy well casings. Fire flooding is normally limited to a maximum depth of about 3000 feet. Both light and heavy ends of the oil are burned. The middle fraction is cracked or oxidized to organic acids.

A popular method of recovery today is the detergent flooding method. In this method, detergents and possibly caustic and/or sacrificial materials are introduced in a water flow. Under ideal conditions, three barrels of water and one pound of detergent will produce one barrel of oil. In a related method, caustic water may be injected into formation. Caustic reacts with naphthenic acids in the oils to form detergents in situ. In this method, clays may create a problem.

An expensive and seldom used method is polymer flooding. Since the viscosity of oil is much higher than water, water often fingers into production wells and once a clear channel is formed, little oil is formed. In polymer flooding, high molecular weight water soluble polymers are injected into the formation to give a bank ahead of the water flood. This equalizes viscosities and produces more of the by-passed oil.

The search continues for more efficient and less expensive methods of recovering oil.

SUMMARY OF THE INVENTION

In the present invention, a method of recovering petroleum fluids from an underground reservoir is disclosed which comprises the initial step of injecting into the reservoir a substantially water insoluble gas which may or may not be oil soluble. If the initial gas is not soluble in oil, a second gas needs to be added. This gas may be soluble in either oil or water, or in both. At this point, the gas/water contact has become gas/oil/water so that the water leg no longer acts as a thief for water soluble gases. The soluble gases dissolve into their solute reservoir fluids. The formation is then treated with one or more compression waves or soundwaves of from one shock wave to fifty thousand cycles per second. This causes the dissolved gases to come out of solution, forcing the entrapped fluids of the reservoir to come out of the capillaries and be produced. The released gases then are redissolved into the freshly exposed oil zone and the cycle repeated until most of the oil is produced.

The method of the present invention is unique in that: only about one pore volume of gas is used; it may be static instead of a dynamic method; in a relatively short period of time the field is producing as if it were primary production; it is cheap; the oil remains substantially the same; substantially higher recovery rates are obtained over present methods with fewer problems.

Thus, the recovery method of the present invention is cheaper, easier to perform and more efficient than the recovery methods of the prior art. Many objects and advantages of the invention will be seen when reading the description which follows in conjunction with the accompanying drawings.

DESCRIPTION OF PREFERRED EMBODIMENTS

Figure 1:
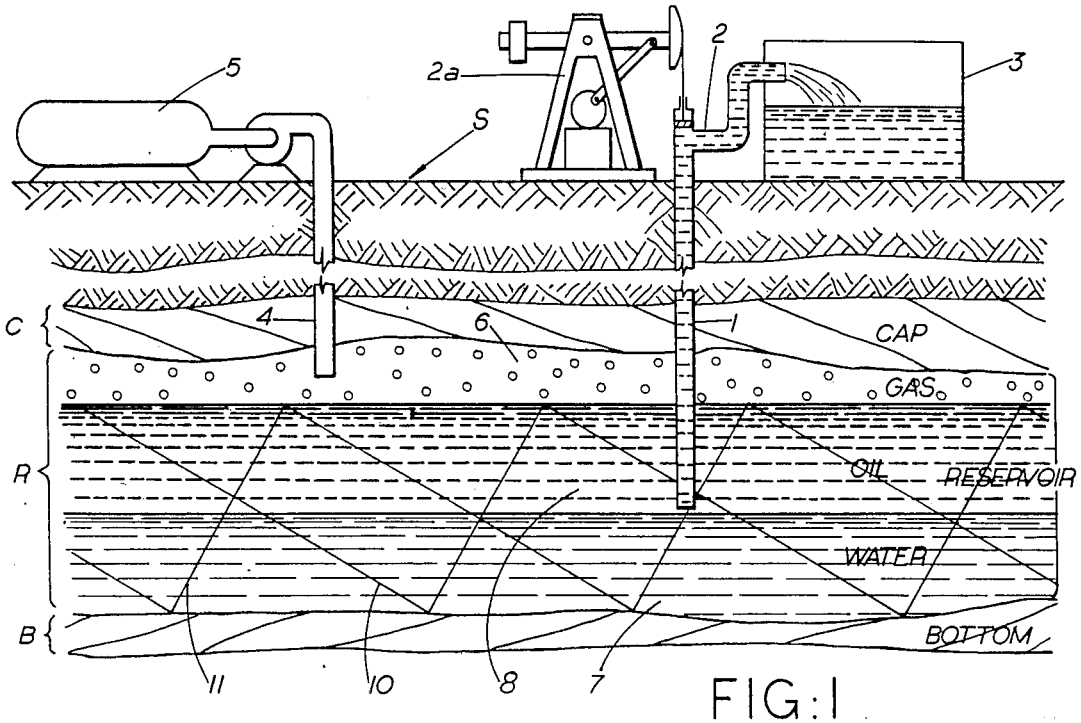
FIG. 1 is a pictorial representation of an underground reservoir in which residual petroleum fluids are being removed by a method according to a preferred embodiment of the invention.

Referring first to FIG. 1, several strata of earth are shown, including an oil-bearing or petroleum reservoir R sandwiched between a lower or basement formation B and an upper or cap formation C. The usual reservoir R originally consisted of sand and water capped by an impervious formation. However, at some time in history, oil seaps into the reservoir R replacing much of the water. The bottom formation B and cap formation C are usually much more impermeable strata acting to retain the oil and water in the reservoir R.

As shown in FIG. 1, the reservoir R is usually penetrated by drilling and completing a well 1 into the reservoir R. The well extends to the surface S and initially may produce oil through a wellhead 2 into a storage tank 3 or pipeline (not shown) at the surface S. There may be enough gas pressure in reservoir R to initially force the oil to the surface. In other cases, pumps 2*a* may be required. After a period of time, the well 1 may cease to produce an economical amount of oil.

In the recovery of the method of the present invention, another well 4 may be drilled so as to penetrate at least the upper portion of the reservoir R for the introduction of gas. Alternatively, gas may be introduced through existing production wells or through separate conduits in the well 1, as a dual completion. In such case, gas would be introduced in the top of the formation and oil produced from a lower part of the formation. However, for purposes of illustration, the recovery method of the present invention will be discussed with reference to a second well 4.

The gas may be injected into the reservoir R through the well 4 by gas compressor 5. The gas initially injected should be substantially water-insoluble gas such as hydrocarbon gases, combustion gases, nitrogen and air. The gases may be injected as is or heated if it is necessary to reduce the viscosity of the oil in the reservoir R such as in the case of heavy crudes. The gas may be injected from the surface S as shown in FIG. 1 or from gas reservoirs beneath the surface S. Air can be injected for downhole ignition as in fire flooding to obtain nitrogen, carbon dioxide and heat.

As the gas is injected a gas cap 6 may form in the reservoir R forcing water 7 and oil 8 toward the bottom of the reservoir R. Due to the characteristics of oil and water, at least some oil 8 will form in the interface between the gas 6 and water 7. At this point, it may be desirable to inject gas which is soluble in water or oil or both water and oil in place of water insoluble gas. These gases may be selected from the group consisting of hydrocarbon gases, carbon dioxide, carbon monoxide, hydrogen sulfide and ammonia.

In shallow fields the average porosity of the reservoir R will be from eighteen to twenty-three percent and the water leg 7 will have a surface area equal to about twenty percent of the isopac (field area). The surface area of the sand in the reservoir will run about one thousand times the surface area of the water leg per foot of thickness. So for a reservoir of twenty feet thickness, the surface area of the same will be one hundred thousand times that of the surface area of the water leg 7. For this reason, one can consider losses to the water leg as negligible. Most of the free water is replaced by gases.

For an explanation of the phenomenum of the recovery method of the present invention, the sand particles in reservoir R may be considered as spheres. The points of contact may be considered as tetrahedrals (four-sided triangle with curved sides). The oil is suspended in these tetrahedral clusters (see 30–41 in FIG. 2) as spherical globules. Especially with heavier crudes, when the specific gravity of oil and water are close, there is little flotation energy to rupture surface tension so as to allow the oil to escape the tetrahedral capsules 30–41.

We will now consider what happens to the oil upon injection of the gases into the reservoir R. The first case considered is the case in which light hydrocarbon gases are injected into the reservoir R. Although light hydrocarbon gases are considered water-insoluble, they will to a limited degree dissolve in water. However, they dissolve in oil to a much higher degree. Therefore, the gases will pass through any water and enter the globules of oil, swelling it slightly. This changes the specific gravity of the oil slightly.

In another case, after injection of the water insoluble light hydrocarbon gases, a water and oil soluble gas such as carbon dioxide and/or hydrogen sulfide may be injected. In this case, the light hydrocarbon gases act as in the previous case but the carbon dioxide and/or hydrogen sulfide enters both the water phase and the oil phase extensively and gets to the hard-to-get oil.

In still another case, a water insoluble light hydrocarbon gas may be injected and then a water soluble gas such as ammonia may be injected. The hydrocarbon gas will act as in the previous cases. The ammonia gas will enter the water phase but being basic will act with the naphthenic acids of the oil to form surfactants, lowering the surface tension of the oil, and when coming out of solution, it pushes the oil and water out.

In still another case, a water insoluble gas insoluble in either water or oil, e.g. nitrogen, air or flue gases, is introduced along with an oil soluble gas, a water soluble gas or a gas soluble in both water and oil.

The soluble gases go into solution in the reservoir fluids. The reservoir is now analogous to a giant can of carbonated cola, which when shaken, causes cola to spew all over. The reservoir may be shaken in many ways. For example, wells may be opened to release gas pressure and start the water leg moving upward. The wells are then closed quickly. The water leg continues upward compressing the gas and then it is shoved back, releasing the pressure. This is called "draw-down". Water may be dropped downhole suddenly into the water leg to give a sudden pressure surge and release. This compression and decompression is heard as sound. An explosion will produce a single high peaked sound followed by rapidly declining smaller peaks. The height of the peaks will diminish as the radius of the circle from the source increases.

If the pressure wave has a fixed frequency, the wave becomes a standing wave and the amplitude becomes greater and greater. This is like taking a board swing and pushing it with one finger every time it comes back to you. Soon the swing will have enough energy to knock someone out who accidently steps into its path.

The release of gases from solution is called cavitation and the pressure differential can be several hundred atmospheres. It is so strong that on high speed propellers of boats, it will actually tear metal out of the propeller.

"Sound" generators may be placed in the reservoir R through the well 1 or at the surface S. There are many types of sound generators which may be utilized. It is not the purpose of the present invention to espouse a particular type of soundwave generation, there being a number commercially available or adaptable from commercially available generators. However, a few types available are: clappers free pistons, whistles, barium titanate crystals for fixed frequencies and magnorestrictive devices, e.g. loudspeakers. The sound generators should be equipped with gyroscopes to keep them aligned when going downhole and are preferably capable of tilting or turning upon command.

As indicated in FIG. 1, the reservoir R can be viewed as a sandwich of a porous medium R sandwiched between two non-porous media, the cap formation C and bottom formation B. These formations, cap C and bottom B, act as excellent walls for sound to bounce off as it is propagated through the reservoir R.

"Soundwaves" have different shapes. An explosion will produce a "soundwave" having a major peak following by diminishing peaks of lower intensity and broader base. "Soundwaves" of fixed frequency are sometimes pictured as simple sine waves with no motion at the nodes and great motion in the wave. Soundwaves may be square waves, sawtooth waves and pulsed waves. In the present invention, it is recommended but not required that square waves be used so that there will be maximum motion in all areas of the reservoir.

"Soundwaves" travel in straight lines and bend only if deflected. Therefore, care should be used in placing the sound generators for best deflection. For example, the generators should not be placed so that sections of the reservoir are blocked by shale lenses which may be present in the reservoir R. The "sound" generators may be placed in the upper portion of reservoir R. They may be placed in, above or below, the overlying cap C or the bottom formation B. They may be placed anywhere in the reservoir R, in the gas cap 6, the oil zone 8 or water leg 7. They may be placed in a shale lens within the reservoir R so that the lens acts as a giant sounding board. There may be one or more generators used simultaneously or not.

It is recommended that the sound be generated for a period of time (soundwaves indicated by 10 and 11) then ceased to allow gas to penetrate freshly exposed oil surfaces. After the soluble gases have been absorbed, the reservoir R may again be subjected to soundwaves. Thus, the soundwaves may be generated and stopped at repeated intervals of time. The frequency at which the sound is generated may vary from a single compression to fifty thousand cycles per second. In practice, a frequency of from fifty cycles to thirty thousand cycles per second is recommended. The reservoir R may be subjected to a single frequency or the frequency may be varied from time to time. This allows vibrations at the nodes of other frequencies and gives a better sweep pattern.

Figure 2:
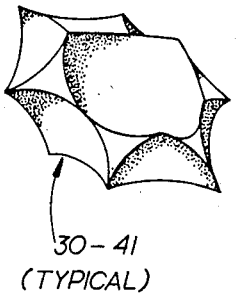
FIG. 2 is a perspective representation of a tetrahedral capsule or cup in which oil may be trapped between sand particles in a watered out petroleum reservoir.
Figure 3:
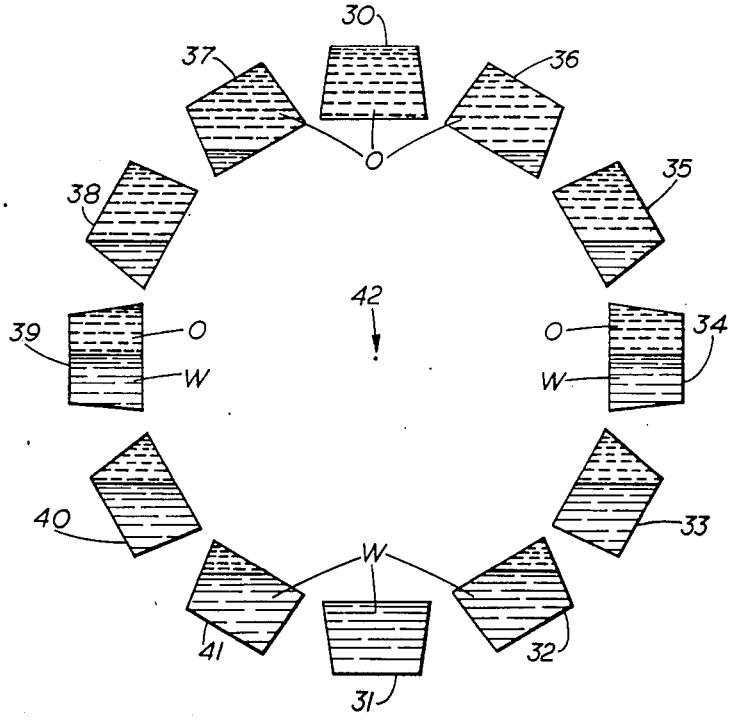
FIG. 3 is a schematic in which tetrahedral capsules between sand particles in a reservoir are represented as an array of cups for purposes of illustrating the present invention.

Let us now examine just what effect these "soundwaves" have on the reservoir R. FIG. 2 shows what the voids in the formation look like. We can consider them to be a series of tetrahedrals (four sided, all concave). They can be considered to be as a series of cups 30–41 mounted on a wheel with their tops turned in (see FIG. 3). Each cup is similar to either the top cup 30 or the bottom cup 31 to a degree. That degree is illustrated by the part similar to the top cup 30 being shown as black, representing oil o, and the bottom 31 as lined, representing water w. The black zone in these cups in the upper half are closed in by the cup. In the bottom, they are closed in by the mouth of the cup.

When a reservoir has initially started producing, water from the water leg rises. If the oil is thin, most of the oil in the bottom cups floats out. Perhaps some of the lined zones of the upper cups are also produced. If a water flood is used, the oil from the lined zones of the upper cups and oil from the lower cups are produced. If the oil is thick, most of the oil in the cups remains behind. A waterflood is ineffective for heavy crudes.

When the water leg advances the pressure is uniform across the face of the reservoir. However, production is only at the wells drilled in the field. The resistance to the oil being produced is due to the viscosity of the oil, which is higher than the water. Therefore, the oil beneath the production wells flows into the well faster than the oil farther out (shorter distance, less amount of viscous fluid). The result is that when the well waters out, pendent oil, primary in nature, hangs down in loops much like a rope suspended from well to well. The more viscous the oil the deeper the loop. This is called "coning". In a water flood, water is injected in a pattern, often as a "five spot," four wells in a square with a fifth in the center. You can either pump down the outer four wells and produce out of the center one or vice versa. The lined portions (w) of the cups plus the black (o) of the bottom cups are produced in the thinner oils as a bank of oil that will eventually break through to the production well after three to four pore volumes of water are introduced. With heavy crudes breakthrough occurs again. The black zones of the upper cups remain untouched. In a thick oil, one will be fortunate to produce the black zones of the bottom cups and the lined zones of the upper cups.

In the method of the present invention, a water insoluble gas is introduced in the top of the formation. It spreads out over the face of the formation, forcing the water leg downward. With a light crude, most of the bottom cups are full of water; the upper cups are full of oil. As the gas/water interface moves downward, oil from the lined upper cups flows downwardly only to be trapped in the empty black zones of the bottom cups. Therefore, the oil produced during this phase is only minimal. Now an oil soluble gas, such as light hydrocarbons (if they have not already been used in water insoluble gas) may be injected or a water/oil soluble gas, e.g. carbon dioxide, or a water soluble gas such as ammonia may be injected.

These gases dissolve into the reservoir fluids much like gas in absorption oil of a natural gasoline plant. When hit by "sonic" vibrations, the gases come out of the fluids. In the upper cups the gas rises to the top of the cup and forces the oil and water out. The displaced water from the upper cup replaces the oil in the black zone of the lower cups. The oil flows quickly downward on a film of cascading water. Surface tension and gravity quickly spread the oil out downward once the water film has been pierced by the oil globule.

When the oil travels downward, it may reach constrictions and accumulate. If only an oil soluble gas has been used in the treatment, the oil will film across the face of the upper cups. The oil soluble gas will start dissolving in the oil and suck it up into the upper cups. However, if part of the gases are both oil and water insoluble, only the oil soluble gas will be replaced and the residual air or nitrogen will hold the oil as a thin film acorss the tetrahedral faces.

Now consider the thick oil in an unconsolidated reservoir of a well drilled into a small reservoir on its flank. There is attic oil that is difficult to get by present methods. This oil is primary oil. When gas is injected, a gas cap is formed below the oil zone. This is an inverted gas cap. The bottom cups are full of water, the upper cups are full of oil. Treatment with oil soluble gases, as before, forces the oil and water out of the upper cups. The oil is more viscous than the water, so when the gases come out of solution in the bottom cups, the oil, because of its greater viscosity, will puff up like a can of shaving cream and overflow downward. Steam may be introduced to lower the viscosity of the crude and to fill the bottom cups with hot water in the newly exposed zones. If each treatment only pushes out ¼ inch of oil per cycle every hour, one week would yield 3½feet of oil production; two weeks would yield seven feet of production, etc.

With a tight formation or a consolidated heavy crude formation, fractures near the top of the formation may be used to introduce gas. The bottom can also be fractured near the oil/water interface if that zone is of lower permeability. The gas cap going down minimizes residual oil banks. Production is similar to that of the previous method.

With heavy crudes it may be desirable to use solvents to reduce the viscosity. These may be added ahead of gases. The use of high frequency vibrations aid in the dissolving of the crude into the solvent. They may be run continuously, but since the rate of sinking of the interface is so slow, it can be used intermediately. The resulting mixture has a lower viscosity and can therefore be more easily moved out of capillaries.

The recovery method of the present invention has been described with reference to FIG. 1, illustrating a rather common type of formation. Of course, there are many types of formations from which petroleum fluids are produced. The reservoir may have two zones of production, an upper less permeable zone and a lower more permeable zone. The upper zone may be fractured and gases injected through a well and introduced into the fracture forcing the oil and water down into the more porous zone where the oil can be produced through the first well or another well.

In a reverse situation the reservoir has an upper more permeable zone and a lower less permeable zone. The less permeable lower zone may be fractured. Gas may be introduced into the more permeable zone through a well and the oil driven down into the fractured portion of the less permeable zone for production through the first well or another well.

In another scenario, the entire formation of the reservoir may be tight. This tight formation may be fractured at the upper part of the formation and at the bottom part of the formation. Gas may be injected through a well and the upper fracture into the upper part of the reservoir driving the oil into the well through the lower fractured area. Or, gas may be injected through the first well into the upper fracture and oil driven into the lower fracture for production through a separate well.

In all of the scenarios described above, a substantially water-insoluble gas is first injected into the reservoir. This may or may not be oil soluble. If it is not oil soluble, then a water soluble or oil soluble gas or water and oil soluble gas must be introduced. The "soundwaves" are generated at the reservoir and directed into the reservoir to release the petroleum fluids retained therein. Finally, the petroleum fluids released are produced through a well communicating with the reservoir. As mentioned, as soon as enough water-insoluble gas is injected into the reservoir and a water/gas interface is formed, water or water and oil soluble gas may be substituted with the water insoluble gas. As also mentioned, the soundwaves generated may be at a frequency of from a single compression wave to fifty thousand cycles per second and the frequency may be constant or it may be varied. In practice, it is expected that the generation of of soundwaves should be conducted for a period of time which is short relative to the period of time for production and that soundwaves would be generated for a period of time, ceased and repeated after intervals of time.

Utilizing the recovery method of the present invention, ninety-five percent of a 22 API gravity and eighty-six percent of a 12 API gravity crude has been recovered. This is a substantial increase over the recovery method of the prior art. In addition, since about one pore volume of gas is all that is required, as opposed to from three to twenty pore volumes of driving fluids required by prior art recovery methods, the cost of recovery is greatly reduced. Thus, recovery efficiency is much greater and cost of recovery is much less.

To demonstrate and substantiate the theory of the method of the present invention, a lab test was performed in the following manner. First a one-inch diameter steel pipe, four feet in length, was vertically disposed. The top of the pipe was closed and provided with a pressure gauge, safety valve and upper flow valve. The bottom of the pipe was attached to a downwardly and outwardly diverging inverted cone, the lower and opened end of which was closed by a metal diaphragm. A lower flow valve was attached to the pipe column near the bottom thereof. Then, 20–40 mesh Ottawa sand was introduced into the pipe column and the pipe column subjected to vibrations to settle the sand. The column contained a total of 1768.0 grams of sand with 466.3 grams being to the level of the lower valve.

Then, water was introduced through the lower valve to the top of the sand, giving 420 ml. of a pore space of 23.74%. 26.36% of the sand was below the exit port of the lower valve. Therefore, 309.3 ml. of water was above the lower valve. Oil was then introduced onto the top of the water through the upper flow valve and the water allowed to drain out of the lower valve, pulling the oil after it. A total of 252 ml. of oil was introduced, giving an oil saturation or 81.5%. The oil was introduced at 70° F. over a two-week period. To simulate a condition after steam flooding, the apparatus was heated to 140° F.

Then, water was introduced via the lower valve to yield primary plus secondary production (secondary considered water to oil ratio of 20:1 which is negligible with a viscous oil). The yield was 52 ml. of oil or 20.6% recovery.

Next, the water was allowed to exit via the lower valve with nitrogen replacing the water. One milliliter (ml.) of oil was produced. To study the effect of heat, the column was allowed to cool to 70° F. and 14 psi of propane was introduced and allowed to stand overnight. The reservoir was then heated to 140° F. again and allowed to stand forty-eight hours. One milliliter (ml.) of oil was produced.

Next, the column was recharged with 14 psi of 50/50 propane/nitrogen and a loudspeaker directly below the metal diaphragm was activated using 1120 Hz at 0.5 amps at five minutes per hour for four hours per day for two days (eight vibration periods). The resulting recovery was 75.8 ml. or 30% to give a total of 50.6% oil recovery. Then, the column was recharged with propane at 14 psi and the soundwave generation repeated. This yielded an additional 28.7 ml. of oil or 11.4% for a total of 62.0% of oil recovery.

To test higher frequency, the column was then treated or recharged with 50% nitrogen and 50% propane and subjected to a sound generation frequency of 20 KHz for twenty hours at five minutes per hour and at 20 amps power. Eight milliliters (ml.) of oil was recovered, for a total recovery of 65%.

To see if oil was being held in the bottom cups by oil breaking to the surface via swelling but not being displaced by in situ water being produced via this method, a water flood was introduced. The yield was only one milliliter (ml.) of oil.

To test to see if some of the oil was too viscous for the gas to penetrate, 30 ml. of mineral spirits was introduced and the water allowed to drip out of the lower valve while 20 KHz of 20 amp power was being continuously applied, thus using the shearing action of the soundwaves to dissolve the crude in the solvent. Only one milliliter (ml.) of oil was produced via the lower valve.

Next, the apparatus was repressured with propane to give a 50/50 mixture of air and propane. Sound was produced at 550 Hz at 0.5 amps and five minutes. Subtracting the 30 ml of mineral spirits, the resulting oil was 8.5 ml or 3.8% more. At this point 69% of the oil was recovered.

At this point, it was apparent that the remaining oil was trapped in the top cups and that the propane was not soluble enough to eject the oil. Then, carbon dioxide, which is soluble in both water and oil, was injected. A 50/50 propane/carbon dioxide mixture was injected at 140° F. at a pressure of 14 psi and sound generated five minutes per hour for a five hour period. The yield was 32.3 ml. of oil and 7 ml. of water, the total oil recovery now being 81.8%. The lower amount of water being produced was significant because carbon dioxide did not blow water out of the bottom cup as in the sudden release of pressure in drawdown experiments and evidently some mineral spirits had entered the top cups, forcing in situ water out.

The same run was repeated for nine hours at a time to give 6.3 ml. of oil or 2.5% for a total of 84.3%. The oil was thin, indicating it had mineral spirits in it. Eight milliliters (ml.) of water was recovered.

Fifteen milliliters (ml.) lighter fluid was then added and capped with 10 ml. water. The column was then pressurized (7½psi carbon dioxide and 7½psi propane) and subjected to 20,000 Hz at 20 amps for four hours, producing 20 cc light oil and hydrocarbon vapors for a total yield of 86.3%. This was to test to see if a light hydrocarbon (which tends to condense in the many crevices of the sand) could be added and later recovered. Such light hydrocarbons can be utilized to produce attic oil and may be introduced without a water flood, acting much like steam. They may also be heated. Injection patterns could be like a series of half-circles whose bottoms are flattened out because hot gases tend to stay at the top of the formation. The injection of an oil or heavier solvent into the gas cap would result in either a series of cones with tips at the injection wells or they would form a globule of oil around the injection well held in place by gases. The cones would be rather broad because in most reservoirs horizontal permeability is much greater than vertical permeability. Vibrations would disperse this condition.

In a blowdown experiment, 1031 grams of sand with 273 ml. of water pore space (above the lower valve) was charged with 214 grams of oil (12 API gravity) and externally heated. Primary production was 33.4%. Using nitrogen followed by propane pressured to 14 psi and suddenly released, 26.4% more recovery was obtained. A second charge of nitrogen and propane yielded an additional 14.9%. Utilizing carbon dioxide for the gas, an additional 1.4%, for a total yield of 76.1% was obtained.

The tests utilizing solvents to increase recovery of 12 API gravity oil indicated that the sand appeared to be partially oil-wet. Oil in oil-wet sands is hydrogen bonded to the oxygen in the sand ($SiO_2$) The hydrogen ion is relatively fluffy and if it can be pried away from the oxygen and replaced with the more compact sodium ion, the hydrogen bonding can be eliminated. For this reason, the oil wet sands may be flooded with a salt solution or any other solution rich in sodium ions. The sodium ion is much more compact than the fluffy hydrogen ion. By flooding with, for example, a three percent salt solution, the hydrogen ion can be replaced by the compact sodium ion so that the oil tends to be balled up and is released for production. In an actual lab test, an additional yield of 9 ml. of oil was obtained, bringing the total oil produced to approximately 90%.

In a continuing portion of this test, the brine or salt solution was dropped in the tube and the sand pack pressurized with a 50/50 mixture of air and carbon dioxide. The sands were then subjected to 20,000 Hz at 10 amps for 5 minutes/hour for six hours. 3 grams of oil were recovered. A repeat of this procedure yielded an additional 3 grams of oil for a total of 92% production. Since a better result had been expected, the tube was opened for checking. The sands appeared to be light tan in color and dry. Upon sharp rapping of the tube with a hammer, the sands flowed out of the tube through the exit port as if dry. However, below the exit port the sands contained crude oil. It became clear that what happened had been that in filling the tube, the bottom had been filled with sand and water to the exit port and weighed. The tube had then been filled with sand to its entirety. The water below the exit port had been drawn up above the port and water added through the exit port was filled to the top. Air had been trapped below the exit port. The descending oil, being very viscous, had kept the air in place. Only when most of the water and oil had been replaced by gas and the vibrations started, did the air go up and the oil come down. This also accounted for the poor showing of propane saturation. However, this did show that the inverted gas cap works. Based upon the color of the sands, it was estimated that 5% of the oil had been lost below the exit port. When the tube was opened, two sharp taps with a hammer released all the reservoir sands. They were dry and almost white.

In order to better study the effect of this process upon oil wet sands, a plug of plaster of Paris topped with solder and epoxy sealant was introduced just below the exit port. The tube was then charged with 1100 grams of dry 20–40 mesh Ottawa sand. 215.8 grams of 22 API gravity crude was introduced through the exit port to fill the pore spaces of the dry sand. Then water was introduced through the exit port to simulate primary production. 36.9 grams of oil was obtained before water breakthrough, indicating 16.68% primary production. Then air was allowed to enter the top and the exit port opened. This simulated the use of an expanding gas cap, after primary production. 156.9 grams of oil was recovered to increase the total production to 72.71%.

Next, carbon dioxide was introduced at a pressure of ½ atmosphere, giving a ⅓ carbon dioxide concentration. Then the column was subjected to vibrations of 400 Hz at 0.2 amps for 10 minutes/hour for a period of eight hours. 23.3 ml. of oil was recovered (10.66% yield) for a total of 83.5% recovery. The time was changed from 5 minutes/ hour to 10 minutes/hour to study the effect of detergent methods on the process.

Since carbon dioxide ($CO_2$) was utilized as the soluble gas, caustic agents, e.g. sodium or potassium hydroxides, phosphates, borates, or silicates, could not be used as spontaneous emulsifiers. Although sacrificial materials could be utilized, it was decided to use brackish brine to limit plating out of the non-ionic detergent. Thus, one gram of salt and one gram of nonylphenol with five moles of ethylene oxide (Triton X-100) was added to 300 grams of water. 20 ml. of this detergent solution was then charged into the top of the tube and gas pressured with a 50/50 mixture of air and carbon dioxide. The tube was subjected to vibrations of 20 Hz at 0.2 amps for 10 minutes/hour for an eight hour treatment.

Theoretically, the detergent should scrub the sands, the vibrations replacing the spontaneous emulsifiers during the 10 minute time period. During the remaining 50 minutes of each hour, the carbon dioxide should dissolve into the solution and when vibrations start up again, the carbon dioxide should come out of the solution, ejecting the detergent downward to lodge in other crevices where it starts cleaning again. Salt prevents plating out of the non-ionic detergent via hydrogen bonding. Theoretically, the one-tenth pore volume of liquid into the gas cap should be lost. However, it was not. The yield was 10 ml. of water (with detergent in it) and 5.7 grams of oil. This additional 2.31% yield of oil made the total recovery 86.14%. While this percentage of oil was relatively low, the oil/water ratio was higher than the ideal 3 to 1 detergent to oil ratio strived for in today's detergent methods. While a non-ionic detergent was utilized, the invention is not so limited. Cationic, anionic and amphorteric detergents may also be used.

When this experiment was run, it was thought that the detergent used would form a stable emulsion and if the oil content was too high, the emulsion might even invert to form a water in oil mixture that would be very viscous. Therefore, a detergent of nonylphenol with ten moles of ethylene oxide added was next used. This detergent emulsifies the crude but the emulsion quickly breaks at this salt concentration. Thus, the action will be the detergent removing the oil from the sand and then breaking it out at the water/gas interface. This resulted in an additional 10 grams of water and 12 grams of oil (5.56% yield) for a total recovery of 91.7%.

Next, 20 ml. of solvent was added to the top of the column and the column subjected to vibrations of 200 Hz at 0.2 amps for 10 minutes/hour for six hours. This resulted in a recovery of 5 ml. of water and 35 ml. of oil. Subtracting 20 ml for the solvent, the net gain was 15 ml. of oil. This is 13.37 grams of oil (6.2% yield) for a total of 97.9% recovery.

Of course, it is easy to add these materials in a lab experiment directly into the tube. However, in the field, the detergent would be added via detergent in oil in a water flood, micellular mixtures floated in on top of a water flood or steam could be injected to form a water barrier across the top of the formation and detergent floated onto the top of the barrier. Still another way would be to have a small gas cap on top of the water flood and inject detergents slowly into the gas cap. It would flow across the surface of the water leg with little mixing because the gas route has less resistance to lateral flow than the water leg. In any event, the lab results show that the use of these solvents and detergents in unconsolidated sands with vibrations is much more efficient than without.

The high yields of these methods indicate that the invention may be used to recover even heavier crudes. The use of hot solvents or ambient temperature solvents coupled or not coupled with "sonic" vibrations to load the solvents with crude is suggested. The use of inert gases plus oil or oil/water followed by sonic vibrations would recover solvent normally lost in the reservoir.

These experiments indicated that hydrocarbon gases alone or in conjunction with nitrogen are effective in producing oil, but the use of water and oil soluble gases such as carbon dioxide or hydrogen sulfide in conjunction with a water insoluble gas results in a better yield. Thus, the laboratory experiment indicated that the recovery method of the present invention is a viable one and that it will result in greater recovery of petroleum fluids from a reservoir in a practical and cost efficient manner.

Although several examples of use of the method of recovering petroleum fluids of the present invention have been described herein, many other variations are possible without departing from the spirit of the invention. Accordingly, it is intended that the scope of the invention be limited only by the claims which follow.

I claim:

1. A method of recovering petroleum from an underground reservoir comprising the steps of:

(a) injecting into said reservoir a substantially water insoluble gas to form a gas cap forcing oil and water toward the bottom of said reservoir;

(b) generating one or more pressure waves and directing said pressure waves into said reservoir to release petroleum fluids retained by said reservoir; and (c) producing said petroleum fluids through a well communicating with said reservoir;

said method being further characterized by performing additional fluid injection steps during step (a).

2. A method of recovering petroleum fluids as set forth in claim 1 in which step (a) includes injecting into said reservoir a hydrocarbon solvent.

3. A method of recovering petroleum fluids as set forth in claim 1 in which step (a) includes injecting into said reservoir and aqueous solution rich in sodium ions.

4. A method of recovering petroleum fluids as set forth in claim 3 in which after said injecting of soduim ion solution and production of petroleum fluids, additional gas is injected into said reservoir and pressure waves are generated and directed into said reservoir to release petroleum fluids still retained by said reservoir.

5. A method of recovering petroleum fluids as set forth in claim 1 in which step (a) includes injecting a detergent solution into said reservoir.

6. A method of recovering petroleum fluids as set forth in Claim 5 in which said one or more pressure waves are alternately stopped and started to allow said gas to dissolve into the detergent solution and come out of solution, respectively.

7. A method of recovering petroleum fluids from an underground reservoir which has been produced to a watered out stage, comprising the steps of:

(a) injecting into said reservoir a substantially water insoluble gas to form a gas cap forcing oil and water toward the bottom of said reservoir;

(b) generating pressure waves and directing said pressure waves into said reservoir to release petroleum fluids retained by said reservoir; and (c) producing said petroleum fluids through a well communicating with said reservoir;

said method being further characterized by performing additional fluid injection steps during step (a).

8. A method of recovering petroleum fluids as set forth in claim 7 in which step (a) includes injecting into said reservoir a hydrocarbon solvent.

9. A method of recovering petroleum fluids as set forth in claim 7 in which step (a) includes injecting into said reservoir an aqueous solution rich in sodium ions.

10. A method of recovering petroleum fluids as set forth in claim 7 in which after said injecting of sodium ion solution and production of petroleum fluids, additional gas is injected into said reservoir and pressure waves are generated and directed into said reservoir to release petroleum fluids still retained by said reservior.

11. A method of recovering petroleum fluids as set forth in claim 7 in which step (a) includes injecting a detergent solution into said reservoir.

12. A method of recovering petroleum fluids as set forth in claim 11 in which said one or more pressure waves are alternately stopped and started to allow said gas to dissolve into the detergent solution and come out of solution, respectively.

13. A method of recovering petroleum fluids from an underground reservoir comprising the steps of:

(a) injecting into said reservoir a substantially water insoluble gas for a time sufficient to force water and oil in said reservoir downwardly and to form water/oil and oil/gas interfaces;

(b) injecting into said reservoir a second gas soluble in water, oil or both water and oil;

(c) generating and directing pressure waves into said reservoir to release petroleum fluids retained by said reservoir; and (d) producing said petroleum fluids through a well communicating with said reservoir;

said method being further characterized by performing additional fluid injection steps during at least one of step (a) and step (b).

14. A method of recovering petroleum fluids as set forth in claim 13 in which at least one of step (a) and step (b) includes injecting into said reservoir a hydrocarbon solvent.

15. A method of recovering petroleum fluids as set forth in claim 13 in which at least one of step (a) and step (b) includes injecting into said reservoir an aqueous solution rich in sodium ions.

16. A method of recovering petroleum fluids as set forth in claim 15 in which after said injecting of sodium ion solution and production of petroleum fluids, additional gas is injected into said reservoir and pressure waves are generated and directed into said reservoir to release petroleum fluids still retained by said reservoir.

17. A method of recovering petroleum fluids as set forth in claim 13 in which at least one of step (a) and step (b) includes injecting a detergent solution into said reservoir.

18. A method of recovering petroleum fluids as set forth in claim 17 in which said one or more pressure waves are alternately stopped and started to allow said gas to dissolve into the detergent solution and come out of solution, respectively.

19. A method of recovering petroleum fluids from an underground reservoir comprising the steps of:

(a) injecting into said reservoir a substantially water insoluble gas to form a gas cap forcing oil and water toward the bottom of said reservoir and forming water/oil and oil/gas interfaces;

(b) if said water insoluble gas is not soluble in oil, injecting into said reservoir a second gas soluble water, oil or both water and oil; and (c) producing said petroleum fluids through a well communicating with said reservoir;

said method being further characterized by generating one or more pressure waves and directing said pressure waves into said reservoir during at least one of step (a) and step (b).

* * * * *